US005836303A

United States Patent [19]

Hurst et al.

[11] Patent Number: 5,836,303

[45] Date of Patent: Nov. 17, 1998

[54] RESPIRATOR APPARATUS

[75] Inventors: Wendell Hurst, Franklin; William J. Nielsen, Troy; Robert C. Metzger, East Lansing; Frederick D. Walker, Middleton, all of Mich.

[73] Assignee: Thermal Air Products, Inc., East Lansing, Mich.

[21] Appl. No.: 719,295

[22] Filed: Sep. 17, 1996

[51] Int. Cl.[6] ..... A62B 7/10

[52] U.S. Cl. ..... 128/206.24; 128/206.21; 128/201.25; 128/201.17; 128/205.27

[58] Field of Search ..... 128/201.25, 201.17, 128/201.23, 206.21, 206.28, 206.24, 206.22, 206.23, 205.27, 205.29

[56] References Cited

U.S. PATENT DOCUMENTS

| | | | |
|---|---|---|---|
| 1,928,764 | 9/1933 | Le Duc | 128/206.24 |
| 1,946,334 | 2/1934 | Schwartz | 128/206.24 |
| 2,314,889 | 3/1943 | Manson et al. | 128/201.23 |
| 2,917,045 | 12/1959 | Schildknecht et al. | 128/206.24 |
| 2,931,356 | 4/1960 | Schwarz | 128/206.24 |
| 3,042,035 | 7/1962 | Coanda | 128/206.24 |
| 3,249,108 | 5/1966 | Terman | 128/206.24 |
| 3,521,630 | 7/1970 | Webster et al. | 128/206.24 |
| 3,971,369 | 7/1976 | Aspelin et al. | 128/206.24 |
| 4,136,691 | 1/1979 | Ebeling et al. | 128/212 |
| 4,454,881 | 6/1984 | Huber et al. | 128/206.24 |
| 4,616,647 | 10/1986 | McCreadie | 128/206.24 |
| 4,641,645 | 2/1987 | Tayebi et al. | 128/206.24 |
| 4,771,771 | 9/1988 | Walther | 128/201.25 |
| 4,867,148 | 9/1989 | Gomez | 128/206.21 |
| 4,951,664 | 8/1990 | Niemeyer | 128/206.24 |
| 4,980,110 | 12/1990 | Nelson et al. | 264/152 |
| 5,003,633 | 4/1991 | Itoh | 128/206.21 |
| 5,140,980 | 8/1992 | Haughey et al. | 128/201.23 |
| 5,433,192 | 7/1995 | Ebeling | 128/201.13 |
| 5,435,299 | 7/1995 | Langman | 128/201.13 |
| 5,529,056 | 6/1996 | Brunson et al. | 128/206.24 |
| 5,558,089 | 9/1996 | Castiglione | 128/206.24 |
| 5,617,849 | 4/1997 | Springett et al. | 128/206.21 |
| 5,641,555 | 6/1997 | Berrigan et al. | 128/206.21 |

FOREIGN PATENT DOCUMENTS 2027353-4 10/1990 Canada .

OTHER PUBLICATIONS

Drawings (2 sheets) by Suomen Jonas Oy, Helsinki, Finland (Suomi ref. No. 13889).

"Breathe Easy" brochure by Suomen Jonas Oy, Helsinki, Finland (1989).

"Keep warm out in the cold" Jonaset brochure by Suomen Jonas Oy, Helsinki, Finland (1989).

*Primary Examiner*—Mark O. Polutta
*Assistant Examiner*—V. Srivastava
*Attorney, Agent, or Firm*—Kohn & Associates

[57] ABSTRACT

A respirator apparatus comprises a mask with a passage and a mesh material disposed across the passage. The mesh material is fused between two layers of the mask material in a molding process. The mask is made of a cross-linked polyethylene material that is flexible, resilient, impervious to liquids, and a good insulator. The cross-linked polyethylene material may be formed to fit the individual facial contours of the wearer, and has a memory. A lip is disposed across the top of the mask, and provides a seal, preventing moist air from escaping that may fog the goggles or the glasses of the wearer.

9 Claims, 2 Drawing Sheets

RESPIRATOR APPARATUS

FIELD OF USE

The present invention relates to a respirator apparatus for use in extreme climates, either cold or hot, that moderates the air temperature inhaled by the wearer, and more particularly, a respirator apparatus having a mask and an opening for a screen-like material.

BACKGROUND OF THE INVENTION

Numerous respirator mask designs have been proposed for skiers, as well as for others, either other sportsmen or people at risk for developing respiratory problems when exposed to extreme cold temperatures for extended periods of time, such as the elderly:

U.S. Pat. No. 4,136,691 (Eberling) discloses a respiratory mask retained by a strap on the face of the wearer. The mask includes a heat exchanger for inhaling and exhaling air, and for recovering humidity from the exhaled air. A continuous strip of wire netting helically wound, enabling air to flow through the mask in a radial manner comprises the heat exchanger.

U.S. Pat. No. 5,433,192 (Eberling) discloses another breathing mask retained by a strap onto the face of the wearer. The heat exchanger portion and the mask portion are made of a biodegradable cellulose material such as short-fibre, high yield hardwood cellulose, such as eucalyptus CTMP fibres or native aspen CTMP pulp.

U.S. Pat. No. 5,435,299 (Langman) discloses yet another respiratory mask for cold environments retained by a strap on the face of the wearer. The opening is covered with a thermally conductive stainless steel mesh or steel wool material, and the mask is made from a closed cell foam.

The wearer is at risk from all air that enters his or her lungs that does not pass through the mesh of the mask, which serves as either a heat exchanger or a filter. The larger the gaps between the mask and the face of the wearer, the greater the risk.

Since the facial contours of individual wearers differ dramatically, what is needed is a mask having contours that closely resemble the contours of the individual wearer, ensuring that the gaps between the mask and the wearer are minimized.

What is needed is a mask configuration that will not only provide increased comfort and protection to the wearer in cold weather applications, but will also be useful in extreme hot temperatures, as well as other applications where masks are needed, such as surgical masks, dust and paint filters masks, and the like.

SUMMARY OF THE INVENTION

The apparatus of the present invention comprises a mask with a passage and a mesh material disposed across the passage, and covers the mouth and nose of a wearer during engagement. The mesh material is larger than the passage. The mask preferably includes at least two layers of material that are fused together in a molding process about the mesh material.

The mask is preferably made of a cross-linked polyethylene material that is flexible, resilient, impervious to liquids, and a good insulator. The cross-linked polyethylene material may be formed to fit the individual facial contours of the wearer by heating the mask.

A lip preferably matches the general contours of the cheek and nose-bridge structure of the wearer, and provides a seal during engagement. The lip is disposed across the cheek and nose-bridge portion of the mask. The lip, is particularly useful in extreme temperature applications, as it blocks moist air that is exhaled and reduces such moisture from escaping and fogging the goggles or glasses of the wearer.

The mask also preferably includes means to secure the mask in place relative to the face, with either an elastic strap, a balaclava hood, or the like.

For a more complete understanding of the respiratory apparatus of the present invention, reference is made to the following detailed description and accompanying drawings in which the presently preferred embodiments of the invention are shown by way of example. As the invention may be embodied in many forms without departing from spirit of essential characteristics thereof, it is expressly understood that the drawings are for purposes of illustration and description only, and are not intended as a definition of the limits of the invention. Throughout the description, like reference numbers refer to the same component throughout the several views.

DETAILED DESCRIPTION OF THE PREFERRED EMBODIMENTS

Figure 2:
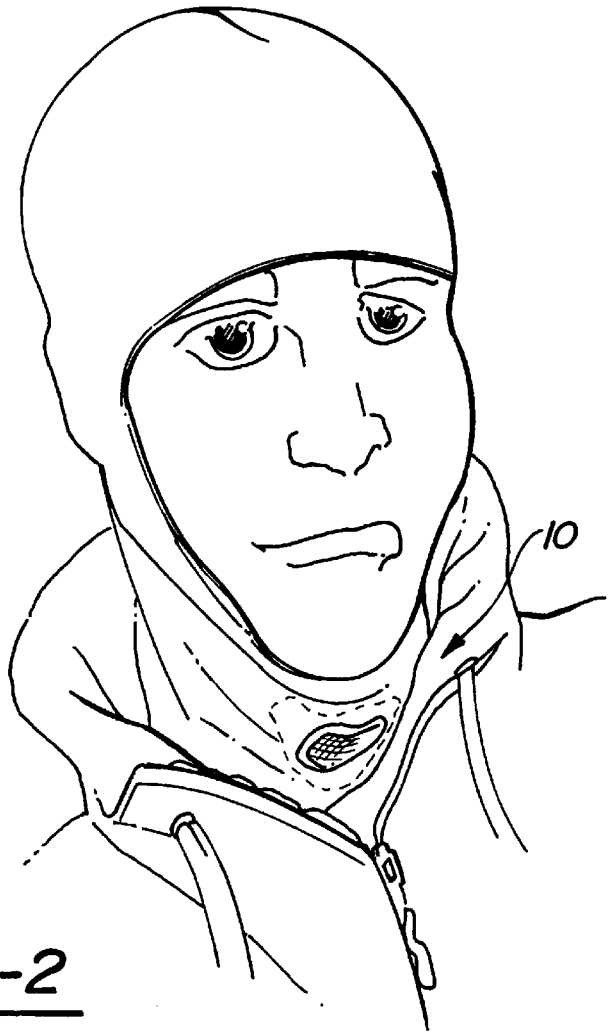
FIG. 2 is a front view of the respirator apparatus of FIG. 1 being retained within the balaclava hood that is disengaged and disposed about the neck of the wearer.
Figure 1:
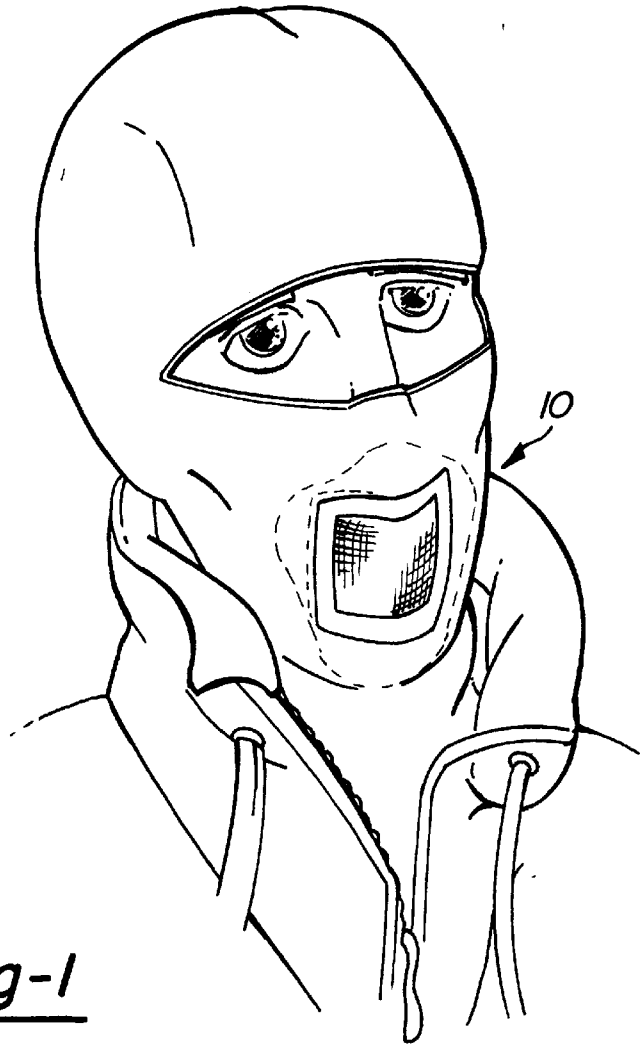
FIG. 1 is a front view of a first embodiment of the respirator apparatus of the present invention, the respirator apparatus being retained within a balaclava hood.

Referring now to the drawings, FIG. 1 discloses the respirator apparatus [10] of the present invention within a balaclava hood that covers the mouth and nose of a wearer during engagement, and FIG. 2 discloses the respiratory apparatus [10] during disengagement.

Since one primary application of the respiratory apparatus [10] of the present invention is to enable moderation of the temperature of air to be inhaled, the first part of the following description will describe the respiratory apparatus [10] with respect to extreme temperature applications.

Figure 3:
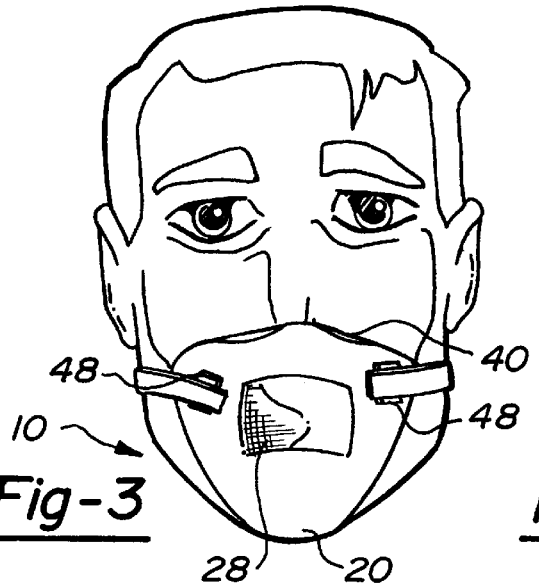
FIG. 3 is a front view of a second embodiment of the respirator apparatus of the present invention, the respirator mask being retained by a strap about the face of the wearer.
Figure 5:
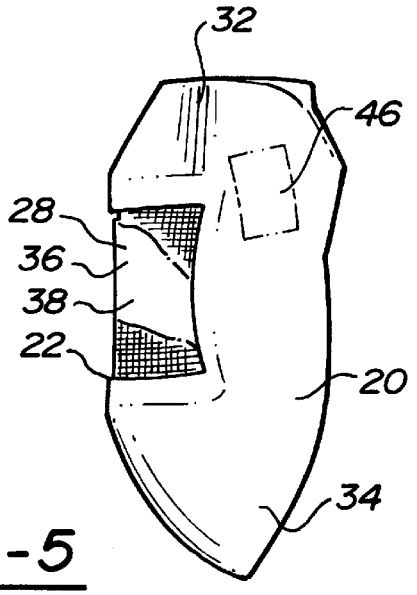
FIG. 5 is a side view of the respirator apparatus of the embodiment shown in FIG. 4.
Figure 6:
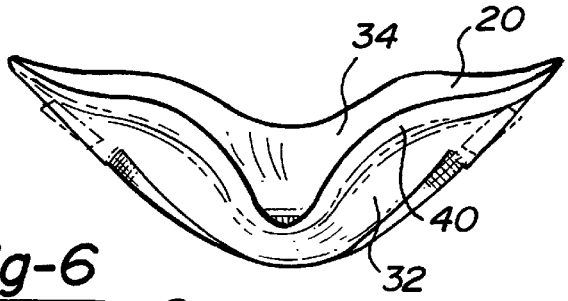
FIG. 6 is a top view of the respirator apparatus of the embodiment shown in FIG. 4.
Figure 4:
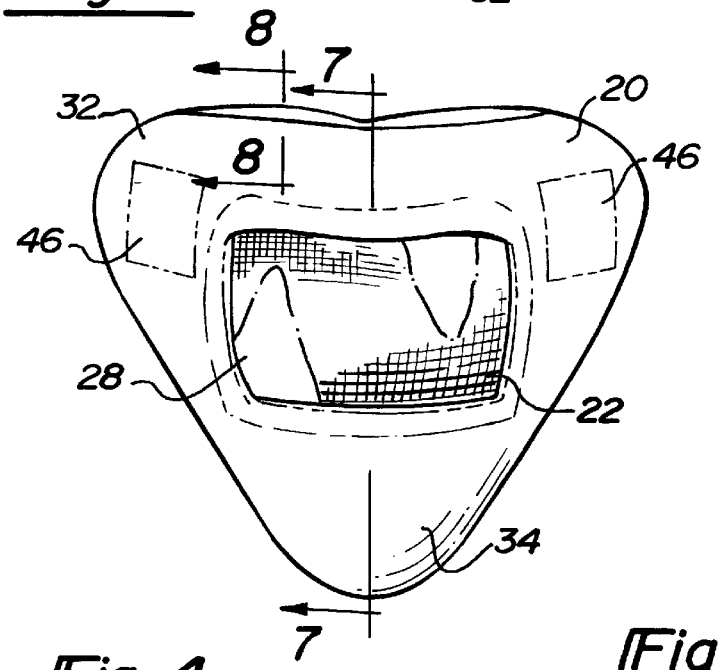
FIG. 4 is a front view of the respirator apparatus of either FIG. 1 or FIG. 3 without any means for engagement relative to the wearer.

The respirator apparatus [10] comprises a mask [20] having an opening [22] therein and a mesh [28] covering the opening [22]. The top portion [32] of the mask [20] engages with the bridge of the nose and the cheekbones of the wearer, and the bottom portion [34] engages with the chin of the wearer. As shown in FIG. 4, the top portion [32] is broader than the bottom portion [34]. The mask [20] protrudes outwardly at the nose and mouth area, and protrudes inwardly at the top portion [32] that engages with the bridge of the nose, and the bottom portion [34] that engages with the chin of the wearer. The opening [22] is preferable centered within the mask [20], fitting near the nose and mouth of the wearer (see FIG. 3).

Figure 7:
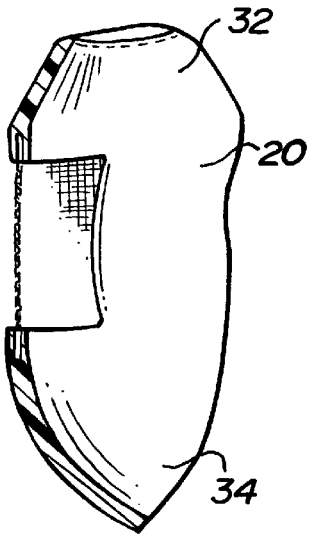
FIG. 7 is a sectional side view of the respiratory apparatus of the present invention, taken along lines 7—7 of FIG. 4.

The mesh [28] is disposed across the opening [22]. The opening [22] includes an air inlet [36] enabling the passage of inhaled air, and an air outlet [38] enabling the passage of exhaled air. The mesh [28] is preferably twenty-eight strands to the inch ("28 by 28"), 0.011 inch of stainless steel wire. The stainless steel material is preferred, since it is acid and corrosion resistant, washable and reusable, nontoxic (not lead), nonallergenic, and thermally conductive (see FIG. 7).

The screen acts as a heat exchanger, and some moisture from the exhaled air is retained within the respiratory apparatus [10] and reheats and hydrates the incoming air being inhaled. The number of mesh [28] layers, the size of the opening [22], the size of the screen and the diameter of the screen wire, are variable to enable maximum heat transfer for specific applications while preventing the mesh [28] from frosting. For extreme temperature applications, either four or six layers of stainless steel are used, wherein for applications involving removing allergens from the air, two layers are used.

A lip [40] preferably extends across the top portion [32] of the mask [20], across the cheek and the bridge of the nose of the wearer. The lip [40] generally closely matches the contour of the cheekbones and bridge of the nose, and provides a seal between the mask [20] and the eyes of the wearer. The lip [40] will prevent warm moist air of near body temperature from escaping to minimize the fogging of goggles or glasses of the wearer.

The mask [20] is made of a cross-linked polyethylene material that is preferably soft, light weight, flexible, impervious to fluids, a good insulator, and resilient.

Figure 8:
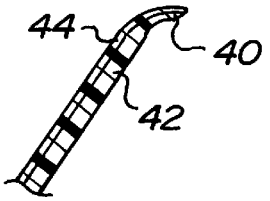
FIG. 8 is a sectional end view of the mask portion of the present invention, taken along lines 8—8 of FIG. 4.

The mask [20] comprises a soft inner shell layer [42] that is comfortable to the skin, and a denser outer shell layer [44] that provides support and rigidity (see FIG. 8). The mesh [28] is larger than the opening [22] in the mask [20] and is disposed between the two layers [42 and 44]. The material is sentinel microcell cross-linked polyethylene foam, and for extreme temperature applications, the outer layer has a density of 3.0 pounds per cubic foot and the inner layer has a density of 2.0 pounds per cubic foot, and a minimum thickness of 3.30 mm is recommended.

The mesh [28] is fused between and with the inner and outer layers [42 and 44] by using the patented molding process described in U.S. Pat. No. 4,980,110, the complete patent specification and drawings are incorporated by reference herein. The molding process ensures stability and bonding of the mesh [28] and the cross-linked polyethylene for rugged and inclement use.

The combination of the molding process and cross-linked polyethylene material enables the wearer to conform the mask [20] to the individual facial features, enabling a snug fit, so that the mask [20] conforms to the individual contours and bone structure of the face of the wearer, whereby essentially all air to be inhaled must enter through the mesh [40], and essentially all exhaled air leaves through the mesh [40].

To change the shape of the mask [20], the wearer will heat the cross-linked polyethylene material in the general temperature range of from 120 to 150 degrees F., perhaps by using boiling water, and then press the mask [20] against his or her face. The cross-linked polyethylene material maintains this shape with memory.

The respiratory apparatus [10] of the present invention may further include means [46] to secure the mask [20] onto the face of the wearer. As shown in FIG. 4, the securing means comprise a pair of adhesive members [48], such as Velcro type hook-and-loop type fasteners, disposed on either side of the opening [22]. The pair of pads [48] are attached by bar-tack stitching on either side of the mask allow for numerous methods of securing the mask [20], and enable the mask [20] to be retained about the head of the wearer, by using an elastic strap, a balaclava hood, a neck gaiter, or a scarf. When the adhesive members [48] are stitched into the mask [20] near the top and on either side of the mesh [28] after the fusion process, the sandwiched layers of the respiratory apparatus [10] will be further stabilized.

Other potential applications for the respiratory apparatus [10] of the present invention include electrostatic materials to remove dust particles from the air, activated charcoal to remove unpleasant odors from the air, surgical masks to protect a physician from the anesthetic, and flame arrectors to protect the lungs of a fireman from flames. Simply by varying the mesh material or by inserting another mesh material between the stainless steel screen, the respiratory apparatus [10] may be used for a range of applications.

The mask [20] material meets or exceeds requirements as listed in UL94 Flammability Classification.

It is evident that many alternatives, modifications, and variations of the respiratory apparatus [10] of the present invention will be apparent to those skilled in the art in light of the disclosure herein. It is intended that the metes and bounds of the present invention be determined by the appended claims rather than by the language of the above specification, and that all such alternatives, modifications, and variations which form a conjointly cooperative equivalent are intended to be included within the spirit and scope of these claims.

We claim:

1. A respirator apparatus that covers facial features of a wearer during engagement, the apparatus comprising:

(a) a mask having a cheek engaging portion, a nose-bridge engaging portion, and a chin engaging portion, the mask having an opening disposed therein, the mask generally matching facial contours of the wearer and providing a seal during engagement, the mask including an inner layer and an outer layer, the inner layer and the outer layer being made of a cross-linked polyethylene material having memory for maintaining a last customized shape;

(b) a mesh material disposed across the opening of the mask, the opening including an air inlet enabling air to be inhaled during engagement to pass therethrough, and an air outlet enabling air to be exhaled during engagement to pass therethrough; and (c) a lip disposed across the cheek engaging portion and the nose-bridge engaging portion of the mask, the lip generally matching the contour of the cheek and nose-bridge structure of the wearer, the lip providing a seal during engagement, the lip being made of a cross-linked polyethylene material having memory for maintaining a last customized shape, the lip preventing moist air of near body temperature that is exhaled during engagement from escaping in an upward direction through the cheek and nose-bridge portions of the mask.

2. The respirator apparatus of claim 1, wherein the mask material is a sentinel microcell cross-linked polyethylene foam.

3. The respirator apparatus of claim 1, wherein the mask material is flexible, resilient, impervious to liquids, and is an insulator.

4. A respirator apparatus that covers facial features of the wearer during engagement, the apparatus comprising:

(a) a mask having a cheek engaging portion, a nose-bridge engaging portion, and a chin engaging portion, the mask having an opening disposed therein, the mask being made of;

an inner layer of material being made of a cross-linked polyethylene material having memory, the cross-linked polyethylene material being flexible, resilient, impervious to liquids and is an insulator, the cross-linked polyethylene material being formed to fit individual facial contours; and an outer layer of material being made of a cross-linked polyethylene material having memory, the cross-linked polyethylene material being flexible, resilient, impervious to liquids, and is an insulator, the cross-linked polyethylene material being formed to fit individual facial contours;

(b) a mesh material disposed across the opening of the mask, the opening including an air inlet enabling air to be inhaled during engagement to pass therethrough, and an air outlet enabling air to be exhaled during engagement to pass therethrough; and (c) means for retaining the mesh material within the mask, the mesh material being larger than the opening, the mesh material being disposed between the inner and outer layers.

5. The respirator apparatus of claim 4, wherein the mesh material is fused between the inner and outer layers in a molding process.

6. The respirator apparatus of claim 4, wherein the inner layer is a sentinel microcell cross-linked polyethylene foam and has a memory for maintaining a last customized shape.

7. The respirator apparatus of claim 4, further comprising a plurality of attachment members, each positioned on either side of the opening.

8. The respirator apparatus of claim 7, wherein the attachment members are affixed to the mask, further stabilizing the retaining means.

9. A respirator apparatus that covers facial features during engagement, the apparatus comprising:

(a) a mask having a cheek engaging portion, a nose-bridge engaging portion, and a chin engaging portion, the mask having an opening disposed therein, the mask generally matching facial contours and providing a seal during engagement, the mask having an inner layer and an outer layer of a polyethylene material having memory;

(b) a mesh material disposed across the opening of the mask, the opening including an air inlet enabling air to be inhaled during engagement to pass therethrough, and an air outlet enabling air to be exhaled during engagement to pass therethrough; and (c) a lip disposed across the cheek engaging portion and the nose-bridge engaging portion of the mask, the lip generally matching the contour of the cheek and nose-bridge structure of a wearer, the lip providing a seal during engagement;

(d) means for retaining the mesh material within the mask, the mesh material being larger than the opening, the mesh material being disposed between the inner and outer layers.

* * * * *